US006184758B1

(12) United States Patent
Ishikawa et al.

(10) Patent No.: US 6,184,758 B1
(45) Date of Patent: Feb. 6, 2001

(54) DIELECTRIC RESONATOR FORMED BY POLYGONAL OPENINGS IN A DIELECTRIC SUBSTRATE, AND A FILTER, DUPLEXER, AND COMMUNICATION APPARATUS USING SAME

(75) Inventors: Yohei Ishikawa, Kyoto; Toshiro Hiratsuka, Kusatsu; Tomiya Sonoda, Muko; Shigeyuki Mikami, Nagaokakyo; Yutaka Ida, Otsu; Kiyoshi Kanagawa, Nagaokakyo, all of (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/035,520

(22) Filed: Mar. 5, 1998

(30) Foreign Application Priority Data

Apr. 18, 1997 (JP) ..... 9-101458
Feb. 18, 1998 (JP) ..... 10-036211

(51) Int. Cl.[7] ..... H01P 1/213; H01P 7/10
(52) U.S. Cl. ..... 333/134; 333/202; 333/219.1
(58) Field of Search ..... 333/202, 204, 333/219, 219.1, 126, 129, 134

(56) References Cited

U.S. PATENT DOCUMENTS 5,764,116 * 6/1998 Ishikawa et al. ..... 333/202
5,804,534 * 9/1998 Zaki ..... 333/99 S X
5,880,650 * 3/1999 Latouche et al. ..... 333/219.1 X
6,016,090 * 1/2000 Iio et al. ..... 333/219.1 X

FOREIGN PATENT DOCUMENTS 0 734 088 A1 * 9/1996 (EP) .
1196977 * 12/1985 (SU) ..... 333/219

* cited by examiner

*Primary Examiner*—Robert Pascal
*Assistant Examiner*—Barbara Summons
(74) *Attorney, Agent, or Firm*—Ostrolenk, Faber, Gerb & Soffen, LLP

(57) ABSTRACT

Proposed are a resonator which can easily establish coupling with input/output means, an external circuit, etc., and a filter, duplexer and communication apparatus each having a wide-band frequency characteristic. Electrodes having polygonal openings defined therein are formed in both principal planes of a dielectric substrate such that the openings are positioned to face each other. The dielectric substrate is arranged with the aid of spacers between a metal-made upper conductor case and a lower conductor case having a shield conductor formed therein, the upper and lower conductor cases being positioned to face each other with gaps left relative to the dielectric substrate. Portions of the dielectric substrate between pairs of the openings facing to each other serve as resonance areas and are coupled respectively with input/output electrodes.

27 Claims, 6 Drawing Sheets

DIELECTRIC RESONATOR FORMED BY POLYGONAL OPENINGS IN A DIELECTRIC SUBSTRATE, AND A FILTER, DUPLEXER, AND COMMUNICATION APPARATUS USING SAME

BACKGROUND OF THE INVENTION

1. Field of the Invention

The present invention relates to a dielectric resonator, a filter, a duplexer and a communication apparatus for use in the bands of microwaves, millimeter waves and so on.

2. Description of the Related Art

Recently, high-capacity and high-speed communication systems have been required to cope with a rapid increase in needs of mobile communication systems and a quick shift to the multimedia society. In response to an increased amount of information to be communicated, the frequency band for use in communications is going to be enlarged from the microwave band to the millimeter-wave band. In the millimeter-wave band, a conventional TE01δ-mode dielectric resonator formed of a columnar dielectric can also be used as in the microwave band. The resonance frequency of the TE01δ-mode dielectric resonator is determined depending on the externals dimensions of the columnar dielectric, and strict machining accuracy has been required to achieve the desired resonance frequency. Because the outer circumference and height of the columnar dielectric are set by grinding, it has been difficult to precisely set strict dimensions with respect to the resonance frequency in the millimeter-wave band where stricter machining accuracy is required.

Also, when a dielectric filter is constructed by arranging a plurality of TE01δ-mode dielectric resonators in a metallic case with predetermined intervals between, the resonators have been required to be arranged with high position accuracy because the coupling between input/-output means such as a metallic loop and the dielectric resonator or the coupling between the dielectric filter and the dielectric resonator is determined depending on the distance between those components.

With a view of solving the above problems, the inventors have proposed in Japanese Patent Application No. 7-62625 a dielectric resonator superior in machining accuracy and a dielectric filter superior in position accuracy.

A basic construction of the dielectric filter according to the above Japanese Patent Application is shown in FIG. 6. FIG. 6 is an exploded perspective view of the dielectric filter according to the above Japanese Patent Application.

As shown in FIG. 6, a dielectric filter 101 is made up of a dielectric substrate 102 and a pair of upper and lower conductor cases 103, 104.

The dielectric substrate 102 is a substrate having a predetermined relative dielectric constant, and has an electrode 102*a* formed all over one principal plane thereof except two circular openings 102*c* each having a predetermined diameter and an electrode 102*b* formed all over the other principal plane thereof except two circular openings 102*d* each having a predetermined diameter. The openings 102*c*, 102*d* each formed two in the respective principal planes are positioned to face each other.

The upper conductor case 103 is made of a metal and has a box-like shape with a lower surface being open. Also, the upper conductor case 103 is arranged while leaving a spacing from the dielectric substrate 102 near the openings 102*c* in the electrode 102*a*.

The lower conductor case 104 is made of a dielectric and has a box-like shape with an upper surface being open and flanges laterally projecting at the bottom. Also, a shield conductor 106 is formed on an inner peripheral surface of the lower conductor case 104, and input/output electrodes 105*a*, 105*b* are formed in positions facing the two openings 102*d* in the electrode 102*b*, respectively, in such a manner as isolated from the shield conductor 106. The input/output electrodes 105*a*, 105*b* are led out respectively through holes 104*a*, 104*b* formed in a side surface of the lower conductor case 104.

Further, a pair of spacers 107 are disposed in the lower conductor case 104 to keep a predetermined spacing between an inner bottom surface of the lower conductor case 104, on which the shield conductor 106 is formed, and the dielectric substrate 102. The spacers 107 are made of a dielectric material having a so low dielectric constant as not to disturb the electromagnetic field in the upper and lower conductor cases 103, 104.

In the dielectric filter having such a structure, electromagnetic energy is confined in the dielectric substrate 102 near its portions each sandwiched between the two opposing openings 102*c*, 102*d* in the electrodes 102*a*, 102*b*, causing those portions to serve as two TE010 mode resonators. As a result, a dielectric filter having resonators in two stages is obtained.

With the above-stated construction, the resonance areas are defined by the size of the openings in the electrodes and the openings can be formed by etching or ether like technique in the manufacture process. Hence a dielectric filter can be manufactured in which dimensional accuracy of resonators and position accuracy between the resonators with respect to the resonance frequency are very precisely reproduced.

In the above dielectric filter 101, however, since electromagnetic energy is confined at a high degree, the coupling between the resonators adjacent to each other has been inevitably weak. Accordingly, when the dielectric filter 101 is manufactured in practice, a narrow-band filtering characteristic has been necessarily resulted due to the weak coupling between the resonators adjacent to each other.

More specifically, when the dielectric filter 101 having a central frequency of 25 GHz was manufactured on condition that a dielectric ceramic substrate being 10 mm×6 mm square and 1 mm thick and having a relative dielectric constant of 24 was used as the dielectric substrate 102, the electrodes 102*a*, 102*b* were made of gold, the diameter of the openings 102*c*, 102*d* was 3.5 mm, the distance (gap) between the two openings 102*c* adjacent to each other or the distance (gap) between the two openings 102*d* adjacent to each other was 0.1 mm, the distance from the inner ceiling surface of the upper conductor case 103 to the upper surface of the dielectric substrate 102 was 1 mm, and the distance from the lower surface of the dielectric substrate 102 to the inner bottom surface of the lower conductor case 104 was 1 mm, the coupling coefficient was less than 1.5% and a resulting band-pass filter had a narrow band with a relative pass band width of approximately 300 MHz.

To make wider the band width of such a band-pass filter, it is conceivable to increase the coupling coefficient by reducing the distance between the resonators (the distance, i.e., gap, between the two openings 102*c* adjacent to each other or the distance between the two openings 102*d* adjacent to each other). There is however a limit in reducing the distance (gap) between the resonators. In practice, a limit of the distance (gap) between the resonators is 0.01 mm. It has been proved that, even in reducing the gap to such a limit value, the coupling coefficient is approximately 2% and the relative pass band width is approximately 400 MHz at maximum.

Furthermore, reducing the distance between the resonators means is equivalent to making smaller the distance between the two openings 102*c* adjacent to each other or the distance between the two openings 102*d* adjacent to each other, and hence has accompanied another problem of making it more difficult to effect patterning of the electrode 102*a* or 102*d*.

In addition, because of weak external coupling between the input/output electrodes 105*a*, 105*b* and the resonators, it has been necessary to optimally arrange the position relationship between the two openings 102*d*, which are formed in the electrode 102*b* on the other principal plane of the dielectric substrate 102, and the dielectric strips 105*a*, 105*b* for the sake of providing the required external coupling. There has been a difficulty in design of the above optimum arrangement.

SUMMARY OF THE INVENTION

The present invention has been made in view of the problems as set forth above, and its object is to provide a resonator which can easily establish coupling with input/output means etc., and a filter which has a wide-band frequency characteristic with a coupling coefficient of not less than 3%.

To achieve the above object, a dielectric resonator according to a first aspect of the present invention comprises a dielectric substrate, electrodes formed on both principal planes of the dielectric substrate, polygonal openings formed in the electrodes, upper and lower conductors arranged while leaving gaps relative to the dielectric substrate, and a resonance area formed near the openings.

By thus forming the openings in the electrodes on both the principal planes of the dielectric substrate to have polygonal shape, an electromagnetic field is generated in a slot mode different from the TE010 mode which has been generated in the prior art using circular openings.

In a dielectric resonator according to a second aspect, a filter according to a sixth aspect, a duplexer according to an eleventh aspect, and a communication apparatus according to a sixteenth aspect, the openings have a rectangular shape.

With that feature, a mode having an electric field running from one side of the rectangular opening to the other side parallel to the one side, i.e., a rectangular slot mode, is produced. At this time, the rectangular slot modes having electric fields in the same direction are produced on upper and lower surfaces of the dielectric substrate.

In a dielectric resonator according to a third aspect, a filter according to a seventh aspect, a duplexer according to a twelfth aspect, and a communication apparatus according to a seventeenth aspect, the openings each have corners one of which is different in shape from the other corners.

With that feature, two rectangular slot modes crossing in orthogonal relation can be coupLed with each other.

In a dielectric resonator according to a fourth aspect, a filter according to an eighth aspect, a duplexer according to a thirteenth aspect, and a communication apparatus according to an eighteenth aspect, the openings each have corners formed into such a shape as obtained by chamfering.

With that feature, concentration of currents into corners of each of the openings can be relieved.

A filter according to a fifth aspect comprises a dielectric substrate, electrodes formed on both principal planes of the dielectric substrate, polygonal openings formed in the electrodes, upper and lower conductors arranged while leaving gaps relative to the dielectric substrate, resonance areas formed near the openings, and input/output means coupled with the resonance areas.

With that feature, a filter having a high degree of external coupling can be obtained.

A duplexer according to a ninth aspect comprises at least a first filter and a second filter, the first filter comprising a dielectric substrate, electrodes formed on both principal planes of the dielectric substrate, polygonal openings formed in the electrodes, upper and lower conductors arranged while leaving gaps relative to the dielectric substrate, resonance areas formed near the openings, and input/output means coupled with the resonance areas, the second filter comprising a dielectric substrate, electrodes formed on both principal planes of the dielectric substrate, polygonal openings formed in the electrodes, upper and lower conductors arranged while leaving gaps relative to the dielectric substrate, resonance areas formed near the openings, and input/output means coupled with the resonance areas, and common input/output means for interconnecting one of the input/output means of the first filter and one of the input/output means of the second filter.

With that feature, a duplexer having a high degree of external coupling can be obtained.

In a duplexer according to a tenth aspect, the dielectric substrate of the first filter and the dielectric substrate of the second filter are the same dielectric substrate.

By thus forming the first filter and the second filter on the same dielectric substrate, the openings to be formed in the electrodes on both the principal planes of the dielectric substrate for the first filter and the second filter can be patterned at a time.

A communication apparatus according to a fourteenth aspect comprises at least a duplexer, a transmitting circuit, a receiving circuit, and an antenna, the duplexer being made up of a transmitting filter comprising a dielectric substrate, electrodes formed on both principal planes of the dielectric substrate, polygonal openings formed in the electrodes, upper and lower conductors arranged while leaving gaps relative to the dielectric substrate, resonance areas formed near the openings, and input/output means coupled with the resonance areas; a receiving filter comprising a dielectric substrate, electrodes formed on both principal planes of the dielectric substrate, polygonal openings formed in the electrodes, upper and lower conductors arranged while leaving gaps relative to the dielectric substrate, resonance areas formed in portions of the dielectric substrate sandwiched between the openings, and input/-output means coupled with the resonance areas; and common input/output means for interconnecting one of the input/output means of the first filter and one of the input/output means of the second filter, the transmitting circuit being connected to the transmitting filter, the receiving circuit being connected to the receiving filter, and the antenna being connected to the common input/output means.

With that feature, a communication apparatus capable of transmitting and receiving a signal over a wider range can be obtained.

In a communication apparatus according to a fifteenth aspect, the dielectric substrate of the transmitting filter and the dielectric substrate of the receiving filter are the same dielectric substrate.

By thus forming the transmitting filter and the receiving filter on the same dielectric substrate, the openings to be formed in the electrodes on both the principal planes of the dielectric substrate for the transmitting filter and the receiving filter can be patterned at a time.

DESCRIPTION OF THE PREFERRED EMBODIMENTS

A first embodiment of the present invention will be described below.

Figure 1:
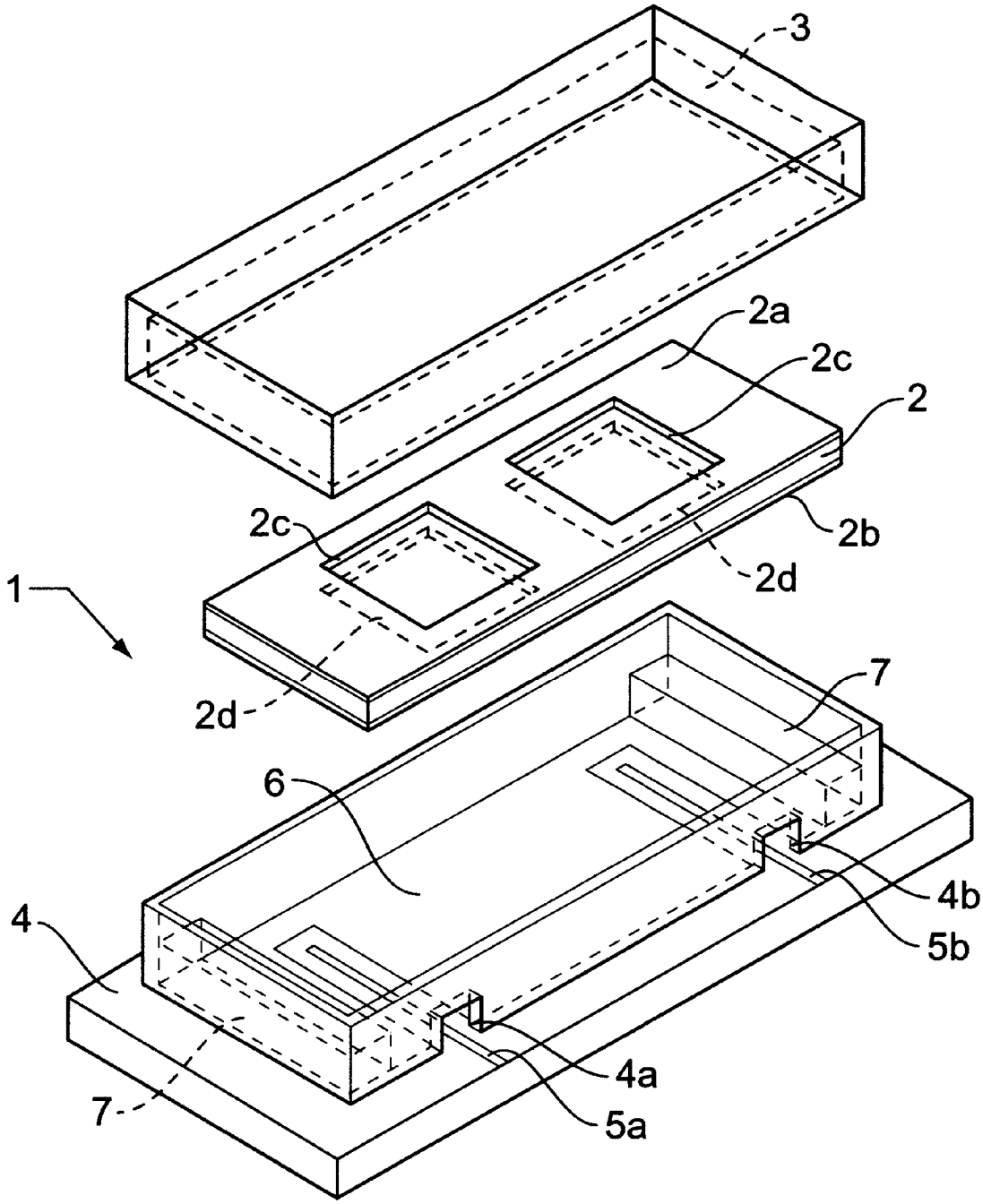
FIG. 1 is an exploded perspective view of a dielectric filter, the view for explaining a first embodiment.

As shown in FIG. 1, a dielectric filter 1 is made up of a dielectric substrate 2 having electrodes formed on its both principal planes and a pair of upper and lower conductor cases 3, 4.

The dielectric substrate 2 is a substrate having a predetermined relative dielectric constant. An electrode 2*a* with two rectangular openings 2*c* defined therein is formed on one principal plane of the dielectric substrate 2, and an electrode 2*b* with two rectangular openings 2*d* defined therein is formed on the other principal plane of the dielectric substrate 2. The openings 2*c*, 2*d* in pair are positioned to face each other.

The upper conductor case 3 is made of a metal and has a box-like shape with a lower surface being open. Also, a recess formed in the upper conductor case 3 to make it open at the lower surface is so dimensioned as to leave a predetermined spacing from the dielectric substrate 2 near the openings 2*c* in the electrode 2*a*.

The lower conductor case 4 is made of a dielectric and has a box-like shape with an upper surface being open and flanges laterally projecting at the bottom. Also, a shield conductor 6 is formed on an inner peripheral surface of the lower conductor case 4, and input/output electrodes 5*a*, 5*b* are formed in positions facing the two openings 2*d* in the electrode 2*b*, respectively, in such a manner as isolated from the shield conductor 6. The input/output electrodes 5*a*, 5*b* are led out respectively through holes 4*a*, 4*b* formed in a side surface of the lower conductor case 4.

Further, a pair of spacers 7 are disposed in the lower conductor case 4 to keep a predetermined spacing between an inner bottom surface of the lower conductor case 4, on which the shield conductor 6 is formed, and the dielectric substrate 2. The spacers 7 are made of a dielectric or metal and arranged in such positions as not to disturb the electromagnetic field in the upper and lower conductor cases 3, 4.

By so forming the openings 2*c*, 2*d* in the electrodes 2*a*, 2*b* on both the principal planes of the dielectric substrate 2 to have rectangular shape, a slot mode having an electric field produced between opposing two of four sides defining each rectangular opening can be utilized. Since the magnetic field is allowed to spread above the openings 2*c* and below the openings 2*d* in such a slot mode, it is possible to strengthen the coupling between the resonators adjacent to each other and the coupling between the resonators and input/output means, e.g., the input/output electrodes.

To confirm such an effect, a filter having a central frequency of 25 GHz was manufactured on condition that a dielectric ceramic substrate being 5.9 mm×3.9 mm square and 0.6 mm thick and having a relative dielectric constant of 24 was used as the dielectric substrate 2, the electrodes 2*a*, 2*b* were made of gold, the openings 2*c*, 2*d* were formed to be 1.2 mm×1.6 mm rectangular, the distance from the inner ceiling surface of the upper conductor case 3 to the electrode 2*a* on the dielectric substrate 2 was 1 mm, and the distance from the inner bottom surface of the lower conductor case 4 to the electrode 2*b* on the dielectric substrate 2 was 1 mm. In this connection, a slot mode having an electric field propagating between the 1.6 mm long sides of each of the openings 2*c*, 2*d* was utilized. Note that a slot mode having an electric field propagating between the 1.2 mm short sides of each of the openings 2*c*, 2*d* was not utilized because this slot mode had a higher central frequency than the slot mode having the electric field propagating between the long sides. The difference in central frequency between the two slot modes is attributable to a difference in length between the parallel long and short sides.

Changes in strength of the coupling between the resonators were examined by varyling the distance between the resonators (the distance, i.e., gap, between the two openings 2*c* adjacent to each other or the distance between the two openings 2*d* adjacent to each other) of the filter of this embodiment. As a result, the coupling coefficient was given relatively high; that is, 1.75% at the distance between the resonators of 0.5 mm, 8.24% at the distance between the resonators of 0.1 mm, 10.7% at the distance between the resonators of 0.05 mm, and 12.8% at the distance between the resonators of 0.02 mm.

Further, the relative pass band width of the filter was wider than conventional; that is, 300 MHZ at the distance between the resonators of 0.5 mm, 1500 MHZ at the distance between the resonators of 0.1 mm, 2000 MHZ at the distance between the resonators of 0.05 mm, and 2500 MHZ at the distance between the resonators of 0.02 mm.

Additionally, comparing with the conventional TE010 mode resonator having a circular opening, the following was resulted.

When resonators having the same central frequency were manufactured by using dielectric substrates with the same dielectric constant and the same thickness, the conventional TE010 mode resonator required a circular opening with a diameter of 3.5 mm, whereas the slot mode resonator of this embodiment required a rectangular opening of 1.2 mm×1.6 mm and a planar area necessary for the resonator was reduced down to about ⅕. Thus, the structure of this embodiment makes it possible to reduce the size of the resonator and hence filter in comparison with the conventional structure on condition of the same frequency.

A second embodiment will now be described with reference to FIG. 2. Note that the same parts as those in the first embodiment explained above in connection with FIG. 1 are denoted by the same reference numerals and are not described here in detail.

This second embodiment differs from the first embodiment in that corners of each of the rectangular openings are rounded.

Figure 2:
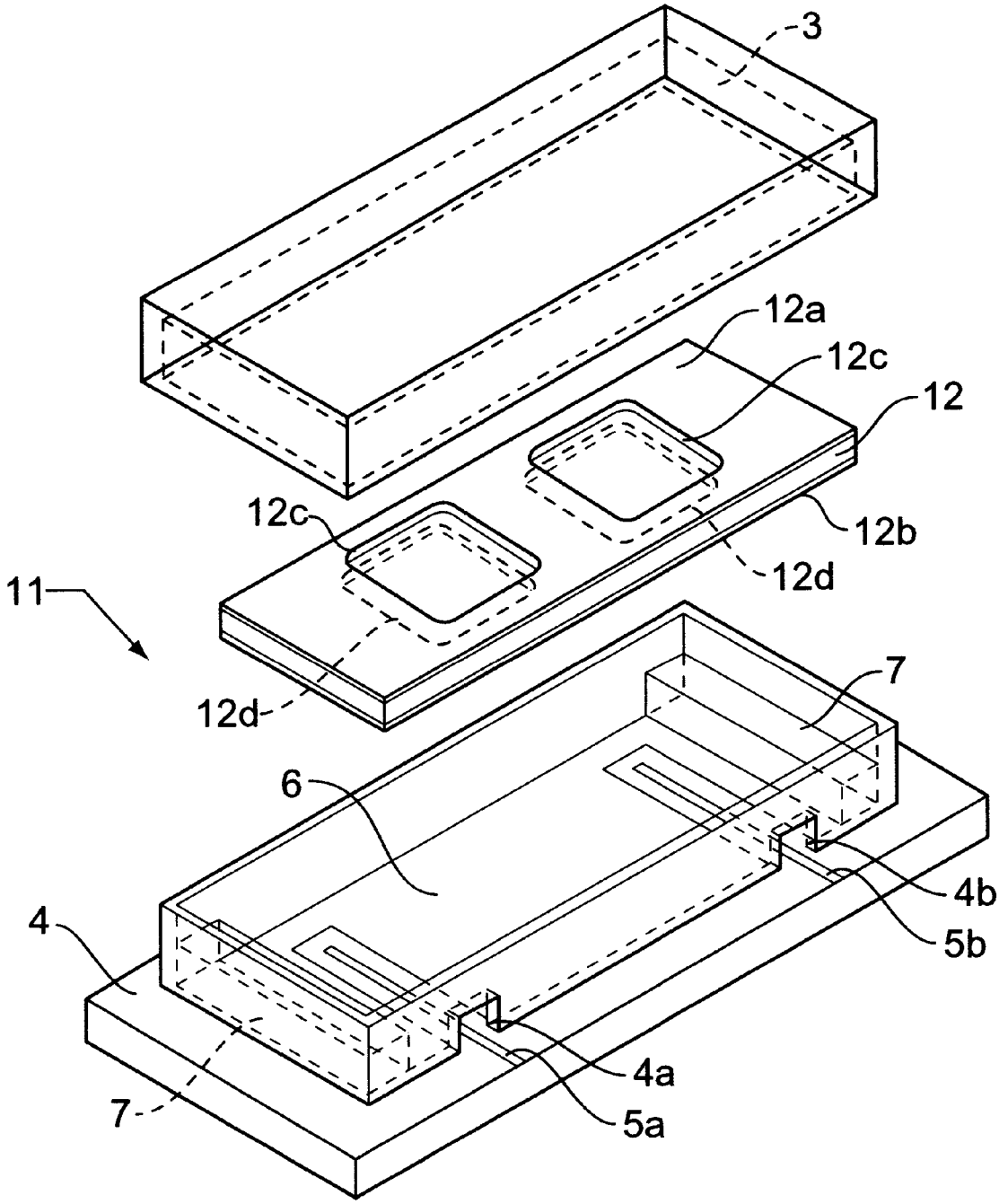
FIG. 2 is an exploded perspective view of a dielectric filter, the view for explaining a second embodiment.

More specifically, as shown in FIG. 2, a dielectric filter 11 also has openings 12*c*, 12*d* defined respectively in electrodes 12*a*, 12*b* which are formed or both principal planes of a dielectric substrate 12. The openings 12*c*, 12*d* are shaped basically rectangular, but rounded at their corners as obtained by chamfering to provide arc-shaped corners with a radius. The term "chamfering" used here does not means a machining step for actually cutting away an angled corner, but implies that each opening is formed in the electrode as a hole having rounded corners in itself.

With the construction explained above, currents flowing along open edges of the electrodes 12*a*, 12*b* defining inner peripheries of the openings 12*c*, 12*d* can be prevented from concentrating into corners of each opening, and hence the no-load Q can be improved.

While concentration of electric fields into the opening corners is relieved in this embodiment by forming the openings to have arc-shaped corners with a radius, the means for avoiding such a concentration of electric fields is not limited to the illustratedone. Other than forming the arc-shaped corners with a radius, the similar advantage can also be obtained by, for example, forming the opening corners to be as obtained by chamfering to provide C-shaped corners, or forming the opening to be substantially octagonal.

A third embodiment will now be described with reference to FIG. 3. Note that the same parts as those in the first embodiment explained above in connection with FIG. 1 are denoted by the same reference numerals and are not described here in detail.

This third embodiment differs from the first embodiment in that the openings are each shaped to be substantially pentagonal with one of four corners of a square formed into a C-shaped corner, and coupling lines 22*e*, 22*f* for interconnecting the openings adjacent to each other.

Figure 3:
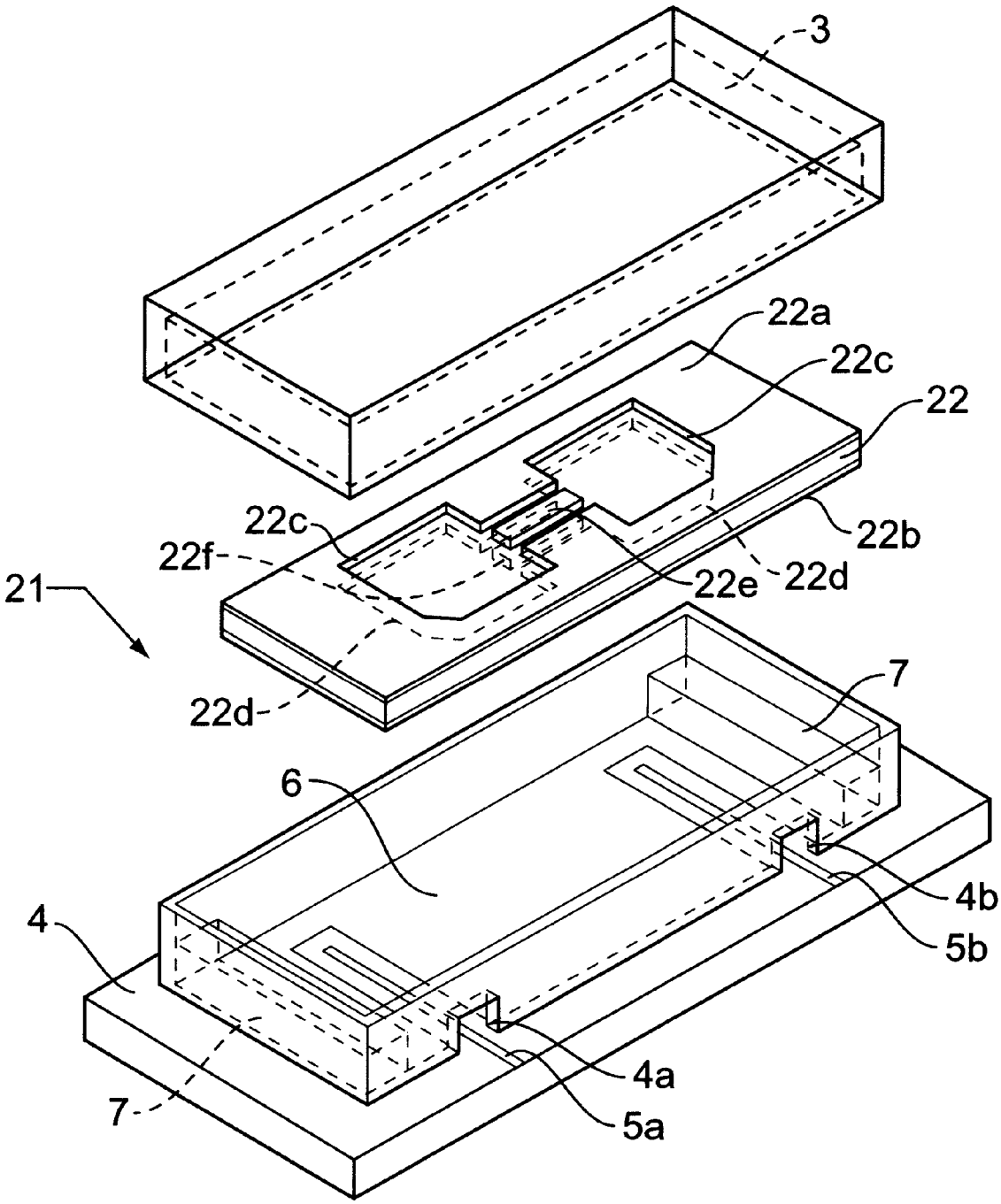
FIG. 3 is an exploded perspective view of a dielectric filter, the view for explaining a third embodiment.

More specifically, as shown in FIG. 3, a dielectric substrate 22 is a substrate having a predetermined relative dielectric constant. An electrode 22*a* having two substantially pentagonal openings 22*c* defined therein with one of four corners of a square formed into a C-shaped corner is formed on one principal plane of the dielectric substrate 22, and an electrode 22*b* having two substantially pentagonal openings 22*d* defined therein with one of four corners of a square formed into a C-shaped corner is formed on the other principal plane of the dielectric substrate 22. The openings 22*c*, 22*d* in pair are positioned to face each other.

In this third embodiment, by forming the openings 22*c*, 22*d* to have a square shape, one resonator constituted by two opposing openings serves as a dual mode resonator. With the openings being each square, since four sides of the square have the same length, slot modes produced between two sets of opposing sides have the same central frequency. In addition, by making one of four corners of the square different in shape from the other three corners, the slot modes produced between two sets of opposing sides can be coupled with each other. Here, one of four corners of the square is formed into a C-shaped corner so as to be different in shape from the other three corners.

Further, as shown in FIG. 3, the coupling line 22*e* comprising a coplanar line is formed on an upper surface of the dielectric substrate 22, i.e., on a surface thereof formed with the electrode 22*a*, to extend between the two openings 22*c* for coupling them with each other. The coupling line 22*f* comprising a coplanar line is formed on a lower surface of the dielectric substrate 22, i.e., on a surface thereof formed with the electrode 22*b*, to extend between the two openings 22*d* for interconnecting them. The coupling lines 22*e*, 22*f* are positioned to face each other with the dielectric substrate 22 between both the lines.

The coupling lines 22*e*, 22*f* serve to couple one resonator made up of one of the opening 22*c* and one of the opening 22*d*, and the other resonator made up of the other opening 22*c* and the other opening 22*d*.

More specifically, in a dielectric filter 21, when an RF signal is input to an input/output electrode 5*a*, the input/output electrode 5*a* is coupled through a magnetic field with a resonator including the opening 22*d* positioned to face the input/output electrodes 5*a* while leaving a gap relative to it. At this time, the slot mode coupling through a magnetic field with the input/output electrode 5*a* is a slot mode having an electric field parallel to the direction of extension of the input/output electrode 5*a* (referred to as a first slot mode hereunder). The first slot mode is coupled in the same resonator with a slot mode having an electric field vertical to the direction of extension of the input/output electrode 5*a* (referred to as a second slot mode hereunder). Then, the second slot mode is coupled through an electric field with a slot mode having an electric field in the same direction as the second slot mode in the adjacent resonator (referred to as a third slot mode hereunder) via the coupling lines 22*e*, 22*f*. The third slot mode is coupled in the adjacent resonator with a slot mode having an electric field vertical to the direction of the electric field of the third slot mode (referred to as a fourth slot mode hereunder). The fourth slot mode is coupled through a magnetic field with the input/output electrode 5*b* and then output from it.

Through the above-explained operation, a four-stage filter utilizing the first to fourth slot modes can be realized.

While the coupling between the resonators is strengthened by the coplanar lines in this embodiment, means for strengthening the coupling between the resonators is not limited to the illustrated one. The coupling between the resonators may be strengthened by interposing a slot, a dielectric or the like between the resonators. Also, while the coupling lines are formed on both surfaces of the dielectric substrate in this embodiment, the coupling line may be formed on only one surface if the required coupling is weaker than obtained in this embodiment.

A duplexer 31 according to a fourth embodiment will now be described with reference to FIG. 4.

Figure 4:
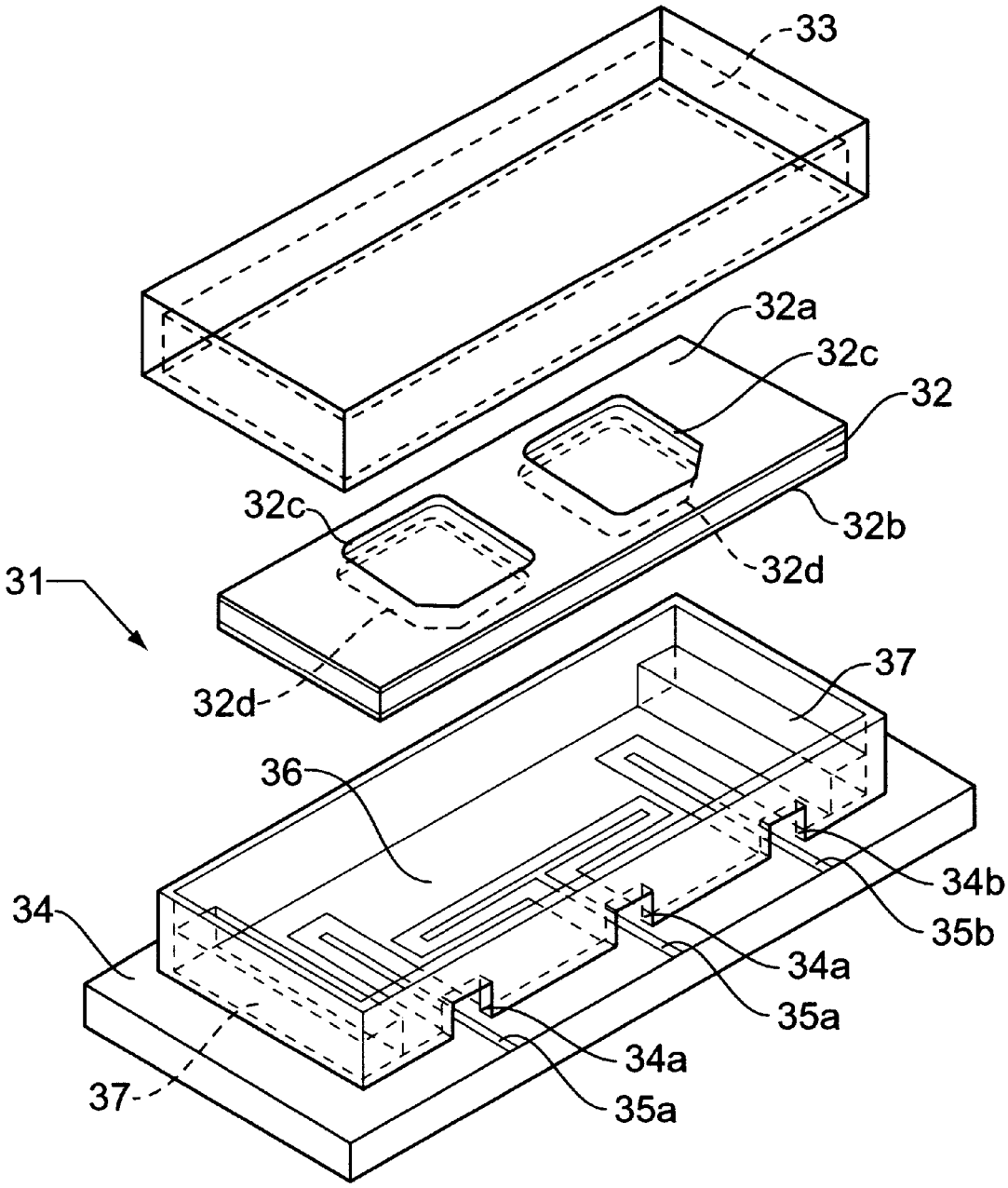
FIG. 4 is an exploded perspective view of a duplexer, the view for explaining a fourth embodiment.

As shown in FIG. 4, a dielectric substrate 32 is a substrate having a predetermined relative dielectric constant. An electrode 32*a* having two substantially pentagonal openings 32*c* defined therein with one of four corners of a square formed into a C-shaped corner and the other three corners formed into an arc-shaped corner with a radius is formed on one principal plane of the dielectric substrate 32, and an electrode 32*b* having two substantially pentagonal openings 32*d* defined therein with one of four corners of a square formed into a C-shaped corner and the other three corners formed into an arc-shaped corner with a radius is formed on the other principal plane of the dielectric substrate 32. The openings 32*c*, 32*d* in palr are positioned to face each other.

In this fourth embodiment, by forming the openings 32*c*, 32*d* to have a square shape, one resonator constituted by two opposing openings serves as a dual mode resonator. With the openings being each square, since four sides of the square have the same length, slot modes produced between two sets of opposing sides have the same central frequency. In addition, by making one of four corners of the square different in shape from the other three corners, the slot modes produced between two sets of opposing sides can be coupled with each other. Here, one of four corners of the square is made different in shape from the other three corners by forming the one corner to have a C-shape and the other three corners to have an arc-shape with a radius.

Further, as shown in FIG. 4, an upper conductor case 33 is made of a metal or the like and has a box-like shape with a lower surface being open. Also, a recess formed in the upper conductor case 33 to make it open at the lower surface is so dimensioned as to leave a predetermined spacing from the dielectric substrate 32 near the openings 32*c* in the electrode 32*a*.

A lower conductor case 34 is made of a dielectric and has a box-like shape with an upper surface being open and flanges laterally projecting at the bottom. Also, a shield conductor 36 is formed on an inner peripheral surface of the lower conductor case 34, and input/output electrodes 35*a*, 35*b*, 35*c* are formed in positions facing the two openings 32*d* in the electrode 32*b* in such a manner as isolated from the shield conductor 36. The input/-output electrodes 35*a*, 35*b*, 35*c* are led out respectively through holes 34*a*, 34*b*, 34*c* formed in a side surface of the lower conductor case 34.

Further, a pair of spacers 37 are disposed in the lower conductor case 34 to keep a predetermined spacing between an inner bottom surface of the lower conductor case 34, on which the shield conductor 36 is formed, and the dielectric substrate 32. The spacers 37 are made of a dielectric or metal and arranged in such positions as not to disturb the electromagnetic field in the upper and lower conductor cases 33, 34.

By thus forming the openings 32*c*, 32*d* in the electrodes 32*a*, 32*b* on both the principal planes of the dielectric substrate 32 to have rectangular shape, a slot mode having an electric field produced between opposing two of four sides defining each rectangular opening can be utilized. Since the magnetic field is allowed to spread above the openings 32*c* and below the openings 32*d* in such a slot mode, it is possible to strengthen the coupling between the resonators adjacent to each other and the coupling between the resonators and input/output means, e.g., the input/output electrodes.

Further, since one of four corners of the square defining each of the openings 32*c*, 32*d* is formed into a C-shaped corner so as to be different in shape from the other three corners, the two slot modes produced between two sets of opposing sides of the square can be coupled with each other.

Additionally, since the other three corners of the square defining each of the openings 32*c*, 32*d* are formed into arc-shaped corners with a radius, currents flowing along open edges of the electrodes 32*a*, 32*b* defining inner peripheries of the openings 32*c*, 32*d* can be prevented from concentrating into corners of each opening, and hence the no-load Q can be improved.

The operation of the duplexer 31 thus constructed will be explained below.

When a received signal is input through the input/-output electrode 35*c* which is connected to an antenna, the input/output electrode 35*c* is coupled through a magnetic field with a resonator including the opening 32*d* positioned to face the input/output electrodes 35*c* while leaving a gap relative to it. At this time, the slot mode coupling through a magnetic field with the input/output electrode 35*c* is a slot mode having an electric field parallel to the direction of extension of the input/output electrode 35*c* (referred to as a first slot mode hereunder). The first slot mode is coupled in the same resonator with a slot mode having an electric field vertical to the direction of extension of the input/output electrode 35*c* (referred to as a second slot mode hereunder). Then, the second slot mode is coupled through a magnetic field with the input/output electrode 35*a* and output to a receiving circuit.

On the other hand, when a transmitted signal is input through the input/output electrode 35*b* which is connected to a transmitting circuit, the input/output electrode 35*b* is coupled through a magnetic field with a resonator including the opening 32*d* positioned to face the input/output electrodes 35*b* while leaving a gap relative to it. At this time, the slot mode coupling through a magnetic field with the input/output electrode 35*b* is a slot mode having an electric field parallel to the direction of extension of the input/output electrode 35*b* (referred to as a third slot mode hereunder). The third slot mode is coupled in the same resonator with a slot mode having an electric field vertical. to the direction of extension of the input/output electrode 35*b* (referred to as a fourth slot mode hereunder). Then, the fourth slot mode is coupled through a magnetic field with the input/output electrode 35*c* and output to the antenna.

Through the above-explained operation, a duplexer made up of a receiving filter having the first and second slot modes and a transmitting filter having the third and fourth slot modes can be realized.

While the input/output electrode 35*a* is connected to the receiving circuit and the input/output electrode 35*b* is connected to the transmitting circuit in this embodiment, the present invention is not limited to such an arrangement. Conversely, the input/output electrode 35*a* may be connected to the transmitting circuit and the input/output electrode 35*b* may be connected to the receiving circuit.

Also, the size of the openings 32*c*, 32*d* which are formed in the electrodes 32*a*, 32*b* on both the principal planes of the dielectric substrate 32 and constitute the transmitting filter may be set different from the size of the openings 32*c*, 32*d* which are formed in the electrodes 32*a*, 32*b* on both the principal planes of the dielectric substrate 32 and constitute the receiving filter so that the transmitting filter has a pass band different from that of the receiving filter.

Figure 5:
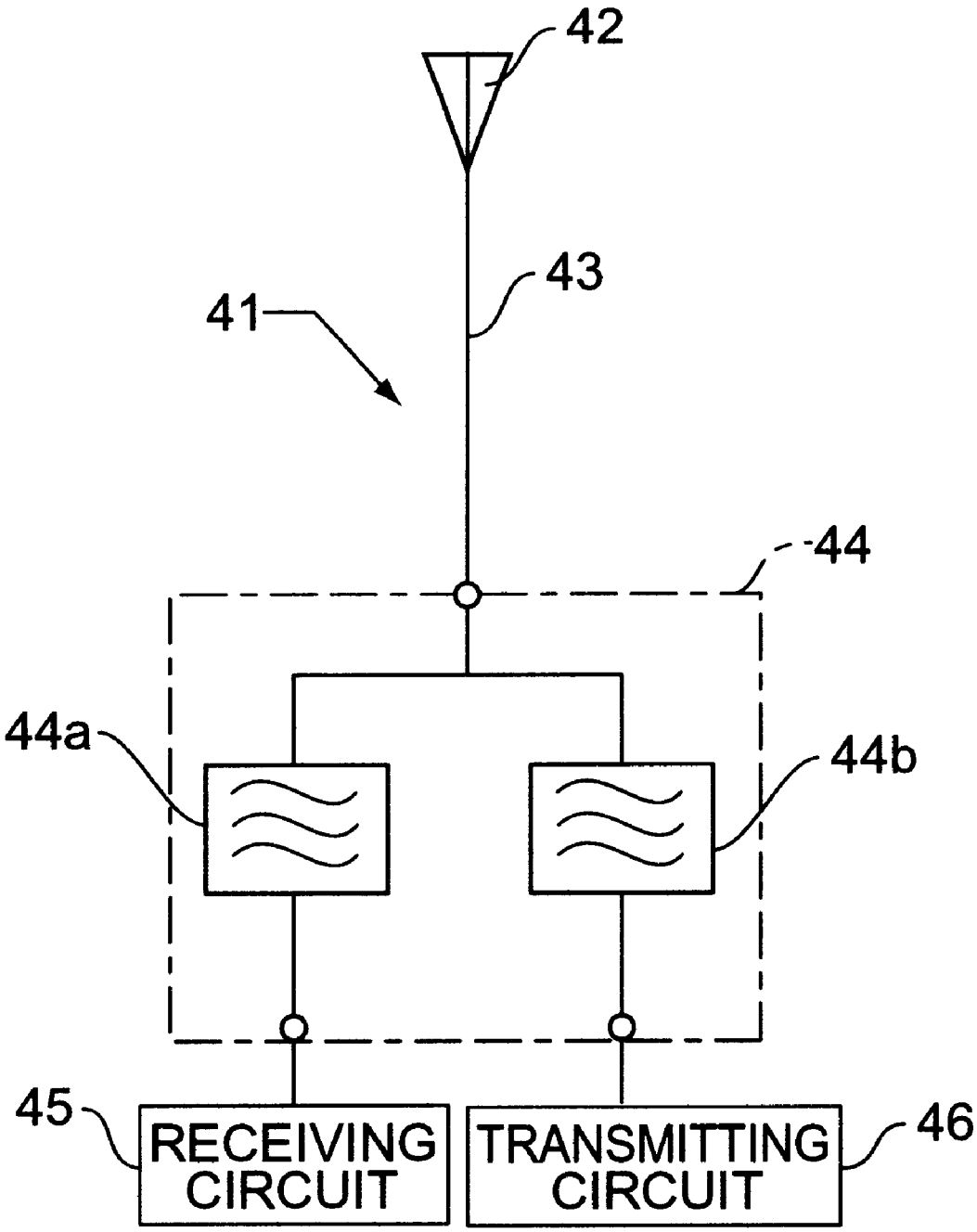
FIG. 5 is a block diagram of a communication apparatus, the view for explaining a fifth embodiment.
Figure 6:
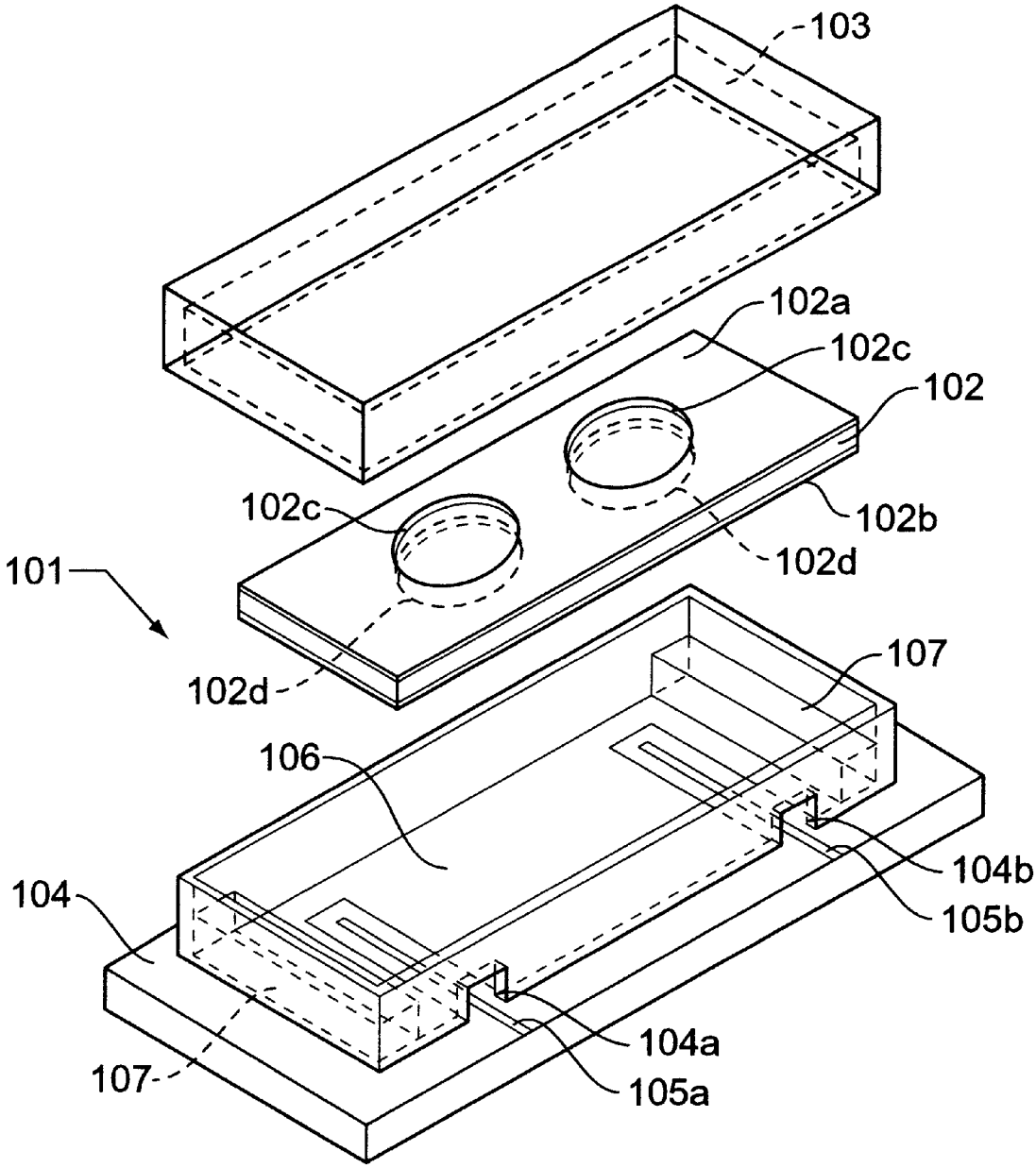
FIG. 6 PRIOR ART
FIG. 6 is an exploded perspective view of a dielectric filter previously proposed by the inventors.

A communication apparatus 41 according to a fifth embodiment will now be described with reference to FIG. 5. As shown in FIG. 5, the communication apparatus 41 is made up of an antenna 42, a transmission line 43, a duplexer portion 44, a receiving circuit 45, and a transmitting circuit 46.

The duplexer portion 44 is made up of a receiving filter 44*a* and a transmitting filter 44*b*. An input terminal of the receiving filter 44*a* and an output terminal of the transmitting filter 44*b* are connected in common. The input/output terminals thus connected in common is in turn connected to the antenna 42 through the transmission line 43 for transmitting and receiving an RF signal. An output terminal of the receiving filter 44*a* is connected to the receiving circuit 45, and an input terminal of the transmitting filter 44*b* is connected to the transmitting circuit 46.

The duplexer portion 44 may comprise the duplexer 31 explained above as the fourth embodiment, and the filters 1, 11, 21 explained above respectively as the first, second and third embodiments may be used as the receiving filter 44*a* and the transmitting filter 44*b*.

While the first to fifth embodiments have been all explained in connection with the band-pass filters, the type of filters is not limited to the band-pass filter. The present invention is also applicable to, for example, a band reject filter and a trap filter.

According to the present invention, as described above, since openings are formed to be polygonal, an electromagnetic field is generated in a slot mode different from the TE010 mode which has been generated in the prior art using circular openings, and therefore the slot mode can be utilized. Since the slot mode produces an electromagnetic field spreading to a larger extent than in the conventional TE010 mode, the slot mode can provide stronger coupling when coupled with input/output means, another resonator, or another circuit. For example, when the present invention is applied to construct a filter or duplexer, the coupling with input/output means can be strengthened. In particular, when the present invention is applied to construct a multi-stage filter or duplexer, a filter or duplexer having a wide-band frequency characteristic can be achieved with the strengthened coupling between resonators. Thus, since the filter and duplexer according to the present invention has a wide-band frequency characteristic, the present invention is also suitable for a communication apparatus Also, since the openings are each formed to be rectangular in the present invention, a mode having an electric field running from one side of the rectangular opening to the other side parallel to the one side, i.e., a rectangular slot mode, is produced and therefore the slot mode can be utilized. The rectangular slot mode is a mode produced between opposing two of four sides of the rectangular opening, and its frequency is determined depending on the length of the opposing sides in a direction parallel to a magnetic field. Hence, the central frequency can be easily determined by setting the length of opposing sides in that direction.

Particularly, by forming one of corners of the opening to be different in shape from the other corners, a multi-mode resonator can be manufactured. Thus, since a single resonator can serve as a multi-stage resonator, a dielectric filter and duplexer having comparable characteristics can be achieved with a half size in comparison with the prior art using circular openings or polygonal openings other than square.

In addition, since corners of the opening are rounded or like as obtained by chamfering in the present invention to relieve concentration of currents into the corners, it is possible to reduce the loss caused by the concentration of currents and hence to improve the no-load Q of the dielectric resonator itself.

What is claimed is:

1. A slot mode dielectric resonator comprising:

a dielectric substrate, electrodes formed on both principal planes of said dielectric substrate, a pair of polygonal openings formed respectively in said electrodes, upper and lower conductors arranged while leaving gaps relative to said dielectric substrate, and a slot mode resonance area formed between said openings.

2. A dielectric resonator according to claim 1, wherein said openings have a rectangular shape.

3. A dielectric resonator according to claim 1, wherein said openings each have chamfered corners.

4. A dielectric resonator according to claim 3, wherein said corners are rounded.

5. A slot mode filter comprising:

a dielectric substrate, electrodes formed on both principal planes of said dielectric substrate, at least a pair of polygonal openings formed respectively in said electrodes, upper and lower conductors arranged while leaving gaps relative to said dielectric substrate, slot mode resonance areas formed between said openings, and input/output electrobes disposed for being electromagnetically coupled with said resonance areas.

6. A filter according to claim 5, wherein said openings have a rectangular shape.

7. A filter according to claim 5, wherein said openings each have chamfered corners.

8. A filter according to claim 7, wherein said corners are rounded.

9. A duplexer comprising:

at least a first slot mode filter and a second slot mode filter, said first filter comprising a dielectric substrate, electrodes formed on both principal planes of said dielectric substrate, at least a pair of polygonal openings formed respectively in said electrodes, upper and lower conductors arranged while leaving gaps relative to said dielectric substrate, slot mode resonance areas formed between said openings, and input/output electrodes disposed for being electromagnetically coupled with said resonance areas, said second filter comprising a dielectric substrate, electrodes formed on both principal planes of said dielectric substrate, at least a pair of polygonal openings formed respectively in said electrodes, upper and lower conductors arranged while leaving gaps relative to said dielectric substrate, slot mode resonance areas formed between said openings, and input/output electrodes disposed for being, electromagnetically coupled with said resonance areas, and a common input/output electrode interconnecting one of the input/output electrodes of said first filter and one of the input/output electrodes of said second filter.

10. A duplexer according to claim 9, wherein the dielectric substrate of said first filter and the dielectric substrate of said second filter are the same dielectric substrate.

11. A duplexer according to claim 9, wherein said openings have a rectangular shape.

12. A duplexer according to claim 9, wherein said openings each have chamfered corners.

13. A duplexer according to claim 12, wherein said corners are rounded.

14. A communication apparatus comprising:

at least a duplexer, a transmitting circuit, and a receiving circuit, said duplexer being made up of a slot mode transmitting filter comprising a dielectric substrate, electrodes formed on both principal planes of said dielectric substrate, at least a pair of polygonal openings formed respectively in said electrodes, upper and lower conductors arranged while leaving gaps relative to said dielectric substrate, slot mode resonance areas formed between said openings, and input/output electrodes disposed for being electromagnetically coupled with said resonance areas; a slot mode receiving filter comprising a dielectric substrate, electrodes formed on both principal planes of said dielectric substrate, at least a pair of polygonal openings formed respectively in said electrodes, upper and lower conductors arranged while leaving gaps relative to said dielectric substrate, slot mode resonance areas formed in portions of said dielectric substrate sandwiched between said openings, and input/output electrodes disposed for being electromagnetically coupled with said resonance areas; and a common input/output electrode interconnecting one of the input/output electrodes of said first filter and one of the input/output electrodes of said second filter, said transmitting circuit being connected to said transmitting filter, and said receiving circuit being connected to said receiving filter.

15. A communication apparatus according to claim 14, wherein the dielectric substrate of said transmitting filter and the dielectric substrate of said receiving filter are the same dielectric substrate.

16. A communication apparatus according to claim 14, wherein said openings have a rectangular shape.

17. A communication apparatus according to claim 14, wherein said openings each have chamfered corners.

18. A communication apparatus according to claim 17, wherein said corners are rounded.

19. A communication apparatus according to claim 14, further comprising an antenna connected to said common input/output electrode.

20. A dielectric resonator comprising:

a dielectric substrate, electrodes formed on both principal planes of said dielectric substrate, a pair of polygonal openings formed respectively in said electrodes, upper and lower conductors arranged while leaving gaps relative to said dielectric substrate, and a resonance area formed between said openings;

wherein said openings each have corners and one corner of each opening is different in shape from the other corners of that opening.

21. A dielectric resonator according to claim 20, wherein the polygonal openings are formed so that the resonance area resonates in a slot mode.

22. A duplexer comprising:

at least a first filter and a second filter, said first filter comprising a dielectric substrate, electrodes formed on both principal planes of said dielectric substrate, at least a pair of polygonal openings formed respectively in said electrodes, upper and lower conductors arranged while leaving gaps relative to said dielectric substrate, resonance areas formed between said openings, and input/output electrodes disposed for being electromagnetically coupled with said resonance areas, said second filter comprising a dielectric substrate, electrodes formed on both principal planes of said dielectric substrate, at least a pair of polygonal openings formed respectively in said electrodes, upper and lower conductors arranged while leaving gaps relative to said dielectric substrate, resonance areas formed between said openings, and input/output electrodes disposed for being electromagnetically coupled with said resonance areas, and a common input/output electrode interconnecting one of the input/output electrodes of said first filter and one of the input/output electrodes of said second filter;

wherein said openings each have corners and one corner of each opening is different in shape from the other corners of that opening.

23. A duplexer according to claim 22, wherein the polygonal openings are formed so that the resonance areas resonate in a slot mode.

24. A filter comprising:

a dielectric substrate, electrodes formed on both principal planes of said dielectric substrate, at least a pair of polygonal openings formed respectively in said electrodes, upper and lower conductors arranged while leaving gaps relative to said dielectric substrate, resonance areas formed between said openings, and input/output electrodes disposed for being electromagnetically coupled with said resonance areas;

wherein said openings each have corners and one corner of each opening is different in shape from the other corners of that opening.

25. A filter according to claim 24, wherein the polygonal openings are formed so that the resonance areas resonate in a slot mode.

26. A communication apparatus comprising:

at least a duplexer, a transmitting circuit, and a receiving circuit, said duplexer being made up of a transmitting filter comprising a dielectric substrate, electrodes formed on both principal planes of said dielectric substrate, at least a pair of polygonal openings formed respectively in said electrodes, upper and lower conductors arranged while leaving gaps relative to said dielectric substrate, resonance areas formed between said openings, and input/output electrodes disposed for being electromagnetically coupled with said resonance areas; a receiving filter comprising a dielectric substrate, electrodes formed on both principal planes of said dielectric substrate, at least a pair of polygonal openings formed respectively in said electrodes, upper and lower conductors arranged while leaving gaps relative to said dielectric substrate, resonance areas formed in portions of said dielectric substrate sandwiched between said openings, and input/output electrodes disposed for being electromagnetically coupled with said resonance areas; and a common input/output electrode interconnecting one of the input/output electrodes of said first filter and one of the input/output electrodes of said second filter, said transmitting circuit being connected to said transmitting filter, and said receiving circuit being connected to said receiving filter;

wherein said openings each have corners and one corner of each opening is different in shape from the other corners of that opening.

27. A communication apparatus according to claim 26, wherein the polygonal openings are formed so that the resonance areas resonate in a slot mode.

* * * * *